US005865137A

United States Patent [19]

Frye

[11] Patent Number: 5,865,137

[45] **Date of Patent: *Feb. 2, 1999**

[54] DUAL CLAMPING SYSTEM

[75] Inventor: Ricky J. Frye, Miamisburg, Ohio

[73] Assignee: MIM Industries, Inc., Miamisburg, Ohio

[ * ] Notice: The term of this patent shall not extend beyond the expiration date of Pat. Nos. 5,377,605 and 5,454,337.

[21] Appl. No.: 527,168

[22] Filed: Sep. 11, 1995

Related U.S. Application Data

[63] Continuation of Ser. No. 273,785, Jul. 12, 1994, Pat. No. 5,454,337, which is a continuation of Ser. No. 913,135, Jul. 14, 1992, Pat. No. 5,377,605.

[51] Int. Cl.[6] ..... D05B 21/00

[52] U.S. Cl. ..... 112/470.14

[58] Field of Search ..... 112/470.06, 470.09, 112/470.12, 470.13, 470.14, 470.18, 475.01

[56] References Cited

U.S. PATENT DOCUMENTS

| | | | |
|---|---|---|---|
| 4,455,952 | 6/1984 | Morin et al. | 112/470.14 X |
| 4,494,470 | 1/1985 | Fischer et al. . | |
| 5,000,103 | 3/1991 | Beermann | 112/470.14 |
| 5,052,316 | 10/1991 | Sakakibara | 112/470.14 X |
| 5,074,230 | 12/1991 | Morii et al. | 112/470.14 |
| 5,156,104 | 10/1992 | Wada | 112/470.14 |
| 5,375,543 | 12/1994 | Birman | 112/470.14 |
| 5,377,605 | 1/1995 | Frye | 112/114 |
| 5,443,025 | 8/1995 | Webb | 112/114 X |
| 5,454,337 | 10/1995 | Frye | 112/475.01 |

*Primary Examiner*—Paul C. Lewis
*Attorney, Agent, or Firm*—Jacox, Meckstroth & Jenkins

[57] ABSTRACT

This invention relates to a dual clamping system for a sewing machine. The dual clamp system comprises a first clamp and a second clamp which may be used to clamp a first workpiece and a second workpiece, respectively, at a sewing station of the sewing machine. The first and second clamps are preferably of different shapes and dimensions so that different shaped workpieces can be clamped at the sewing station. In the preferred embodiment, the first and second clamps are adjustable inner clamps for clamping an inner portion of the first and second workpieces, respectively. The dual clamping system also comprises a peripheral clamp for clamping at least a portion of the periphery of either or both of the first and second workpieces at the sewing station. The dual clamping system permits an operator to either separately or simultaneously clamp and sew a plurality of workpieces having the same or different shapes.

49 Claims, 3 Drawing Sheets

DUAL CLAMPING SYSTEM

RELATED APPLICATION

This application is a continuation of Ser. No. 08/273,785 filed Jul. 12, 1994, now U.S. Pat. No. 5,454,337 which is a continuation of Ser. No. 07/913,135 filed Jul. 14, 1992, now U.S. Pat. No. 5,377,605 issued Jan. 3, 1995.

BACKGROUND OF THE INVENTION

1. Field of the Invention

This invention relates to a sewing machine, and more particularly, it relates to a dual clamping system having a first clamp and a second clamp which are capable of either separately or simultaneously clamping a first workpiece and a second workpiece, respectively, against a sewing surface in the sewing machine.

2. Description of the Related Art

In the sewing industry, the use of a clamp to clamp or hold workpieces at a sewing station is quite common. It is also common to use a clamp to clamp a label, patch or emblem onto a workpiece, such as a shirt or jacket, so that the label patch or emblem can be sewn thereon. One problem with the sewing machines of the past was that they were only equipped to clamp one workpiece at a time. When manufacturing workpieces having two or more labels sewn thereon, it was often necessary to separately clamp and sew each label onto the workpiece. This usually required a separate clamping and sewing operation for each label.

Another problem was that the operator had to stop sewing the workpiece and change clamps whenever two or more labels of different sizes were to be sewn on the workpiece. For example, if two labels were to be sewn on the workpiece, the operator would clamp and sew the first label with a first clamp. The operator would then change the clamp in the sewing machine and replace it with another clamp that was suitable for clamping the second label. The operator would then clamp and sew the second label. This procedure would be repeated for each different label. The sewing machine usually had to be shut down whenever the operator had to change clamps. This down time resulted in lost production and labor time.

As an alternative approach, an operator would sew a first label on all of the workpieces with a first clamp, and then the operator would change clamps and sew a second label on all of the workpiece with a second clamp. This required that the operator position the workpiece at the sewing station at least two times, thereby resulting in a duplication and repetition of production and labor time.

SUMMARY OF THE INVENTION

There is, therefore, a present need to provide a dual clamping system for clamping a first workpiece and a second workpiece against a sewing surface in a sewing machine, without having to change clamps in the sewing machine.

In one aspect, this invention comprises a clamping system for clamping a plurality of workpieces against a sewing surface in a sewing machine, said clamping system comprising a clamp for securing said plurality of workpieces against said sewing surface; and a driver for coupling said clamp to the sewing machine; said driver being capable of driving said clamp into engagement with said plurality of workpieces to secure said plurality of workpieces against said sewing surface.

An object of this invention is to provide a dual clamping system which can clamp two or more workpieces at a sewing station in a sewing machine.

Another object of this invention is to provide a dual clamping system which is capable of clamping two or more workpieces having different shapes at a sewing station in the sewing machine, without the need for changing clamps.

Yet another object of this invention is to provide a dual clamping system which is capable of sewing labels having different shapes.

Still another object of this invention is to provide a dual clamping system which is capable of clamping an inner portion of the workpiece.

These objects, and others, may be more readily understood in connection with the following specification, claims, and drawing.

DESCRIPTION OF THE PREFERRED EMBODIMENT

Figure 1:
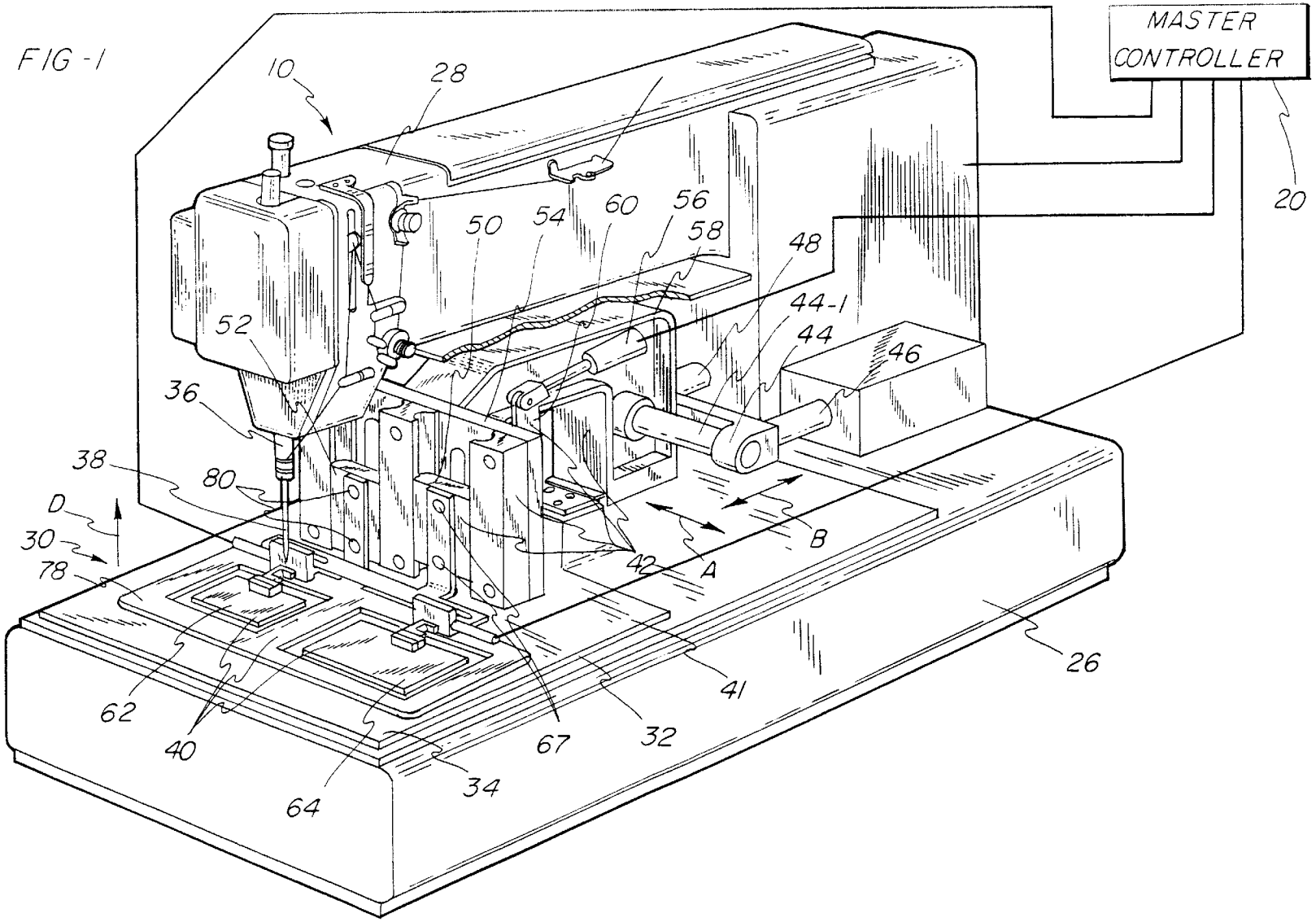
FIG. 1 is a perspective view of a sewing machine in which an embodiment of this invention may be used.

FIG. 1 shows a perspective view of a sewing machine, hereinafter designated a sewing machine 10 in which a preferred embodiment of this invention may be used. The function of the sewing machine 10 is to sew a first workpiece 12 (FIG. 2) and a second workpiece 14 onto a receiving workpiece 16. In the embodiment being described, the workpiece 12 is sewn onto the receiving workpiece 16 with a first predetermined stitch pattern 18 in accordance with a computer program (not shown) which is controlled by a master controller 20 in the sewing machine 10. Likewise, the second workpiece 14 is sewn onto the receiving workpiece 16 with a second predetermined stitch pattern 21. The sewing machine 10 may be a programmable sewing machine, such as the Brother BAS Model 340 which is manufactured by Brother Industries of Japan. The sewing machine 10 comprises a base 26 (FIG. 1) having a horizontal arm 28 secured thereto. The sewing machine 10 also comprises a sewing station 30 at which the first and second workpieces 12 and 14 can be clamped against a cloth plate 32 which provides a clamping or sewing surface 34.

As best illustrated in FIG. 1, the horizontal arm 28 extends out over the sewing surface 34, and it has a needle holder 36 which supports a needle 38 for reciprocating motion in a fixed path that is generally vertical and perpendicular to the sewing surface 34. The needle 38 moves down through a hole (not shown) in a throat plate (not shown) at the bottom of its stroke to transfer a loop of thread (not shown) to a loop taker (not shown) under the sewing surface 34 at the sewing station 30. The loop taker (not shown) and needle holder 36 are both connected to a motor (not shown) which is controlled by the master controller 20 in the sewing machine 10.

The sewing machine 10 further includes a dual clamp system 40 which is coupled to a driver assembly or drive means 42. A function of drive means 42 is to move the dual clamp system 40 and cloth plate 32 over the sewing surface 34 in accordance with the computer programs (not shown) in order to sew the first and second workpieces 12 and 14 onto the receiving workpiece 16 with the first and second predetermined stitch patterns 18 and 21, respectively. The drive means 42 comprises a yoke 44 having a yoke shaft 44-1 which permits the dual clamp system 40 to move in an X direction indicated by double arrow A in FIG. 1. The yoke 44 is coupled to a pair of shafts 46 and 48 which can cause the yoke 44 and dual clamp system 40 to move in a Y direction, indicated by double arrow B. The shafts 46 and 48 are coupled to a stepper motor (not shown) by various belts, gears and pulleys (not shown) in the sewing machine 10. The master controller 20 can energize the stepper motors, individually or simultaneously, to move the dual clamp system 40 in accordance with the computer program (not shown) so that the first and second workpieces 12 and 14 can be sewn onto the receiving workpiece 16 with the first and second predetermined stitch patterns 18 and 21, respectively.

The drive means 42 of sewing machine 10 also comprises mounting means for detachably and adjustably mounting the dual clamp system 40 to sewing machine 10. In the embodiment being described, mounting means comprises a pair of brackets 50 and 52 which are slidably mounted in a bracket support 54, as best illustrated in FIG. 1. The bracket 50 is coupled to a solenoid 56 which is conventionally mounted on the arch member 58 via an armature 60. Likewise, the bracket 52 is mounted to a similar solenoid (not shown) which is mounted on the opposite side (as viewed in FIG. 1) of the arch member 58. The master controller 20 can energize the solenoids to cause the brackets 50 and 52 to move up and down in the bracket support 54 and towards and away from the sewing surface 34. Although mounting means has been shown and described as including, for example, the arch member 58, solenoid 56 and sliding brackets 50 and 52, it could comprise any suitable means for detachably and adjustably mounting the dual clamp system 40 to the sewing machine 10. Likewise, the drive means could comprise any suitable means for moving the dual clamp system 40 at the sewing station 30.

Figure 2:
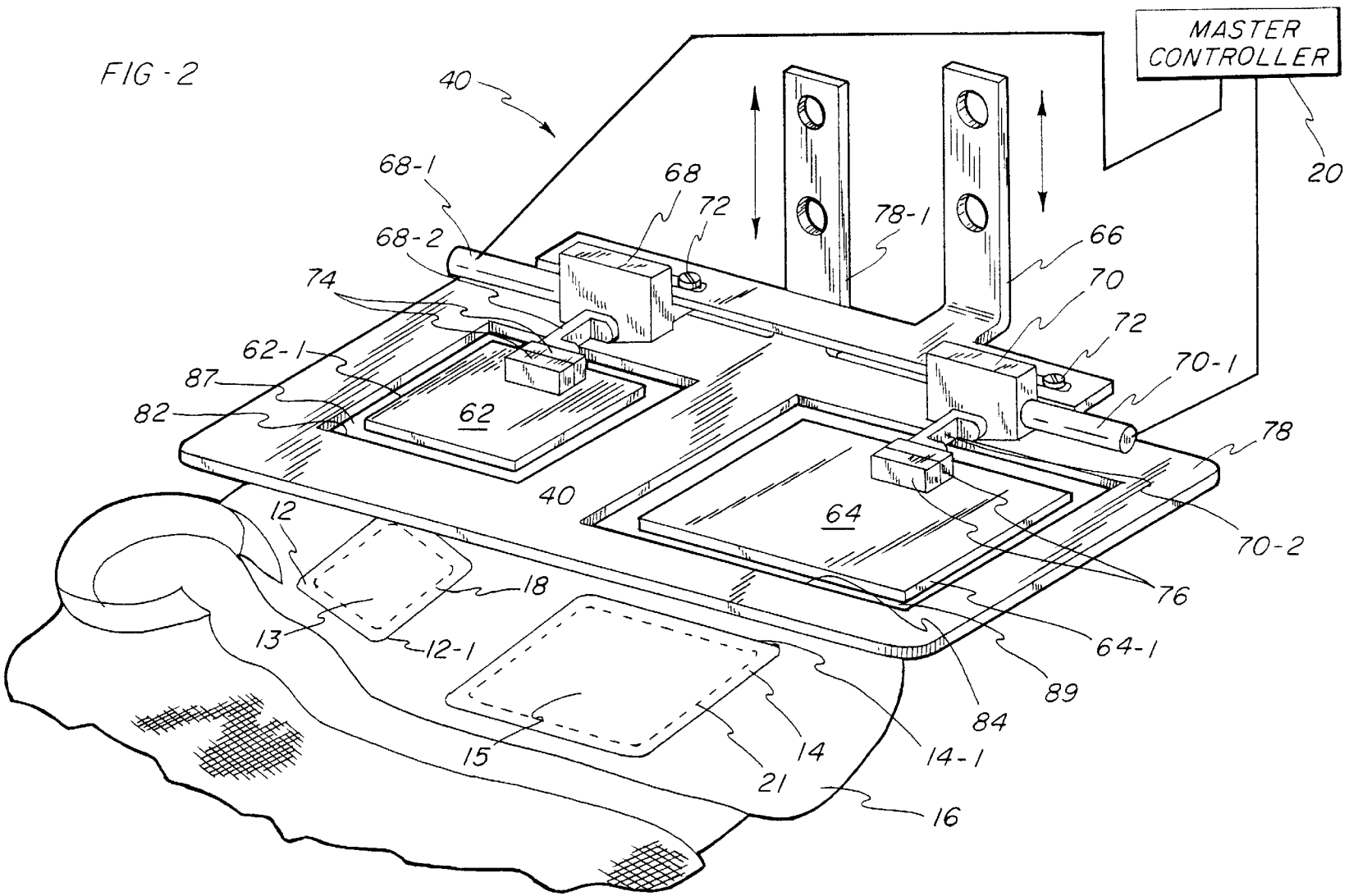
FIG. 2 is a perspective assembled view of a dual clamping system shown in FIG. 1.

As best illustrated in FIG. 2, the dual clamp system 40 comprises a first clamp 62 for clamping an inner portion 13 of the first workpiece 12 and a second clamp 64 for clamping an inner portion 15 of the second workpiece 14. The dual clamp system 40 also comprises coupling means or a first L-shaped bracket 66 which is secured to bracket 50 by suitable means such as screws 67 (FIG. 1). As best shown in FIG. 2, coupling means also comprises a first 360° coupling 68-2 and a second 360° coupling 70-2 slidably secured thereto by suitable means, such as flat head screws 72. The first and second 360° couplings 68 and 70 couple the first and second clamps 62 and 64, respectively, to the first L-shaped bracket 66, as shown in FIG. 2. The first 360° coupling 68 has a solenoid 68-1 and the second 360° coupling has a solenoid 70-1. The solenoids 68-1 and 70-1 are coupled to the master controller 20, as illustrated in FIG. 2, which can selectively energize the solenoids 68-1 and 70-1 and thereby cause cranks 68-2 and 70-2 to flip-flop so that the sewing machine 10 can sew stitch patterns which are endless or continuous.

The coupling means further comprises a first quick release mechanism 74 and a second quick release mechanism 76 which enable the first and second clamp 62 and 64, respectively, to be quickly and easily dismounted from the L-shaped bracket 66. The first and second quick release mechanisms 74 and 76 are similar to the release mechanisms shown and described in U.S. Pat. No. 4,763,587, issued on Aug. 16, 1988; U.S. Pat. No. 4,870,917, issued on Oct. 3, 1989; and U.S. Pat. No. 5,101,746, issued on Apr. 7, 1992, which are assigned to the same assignee as the present invention and which are hereby incorporated by reference and made a part hereof. Although not shown, the coupling means could include any suitable structure or arrangement for coupling the first and second clamps 62 and 64 to the L-shaped bracket 66.

Figure 3:
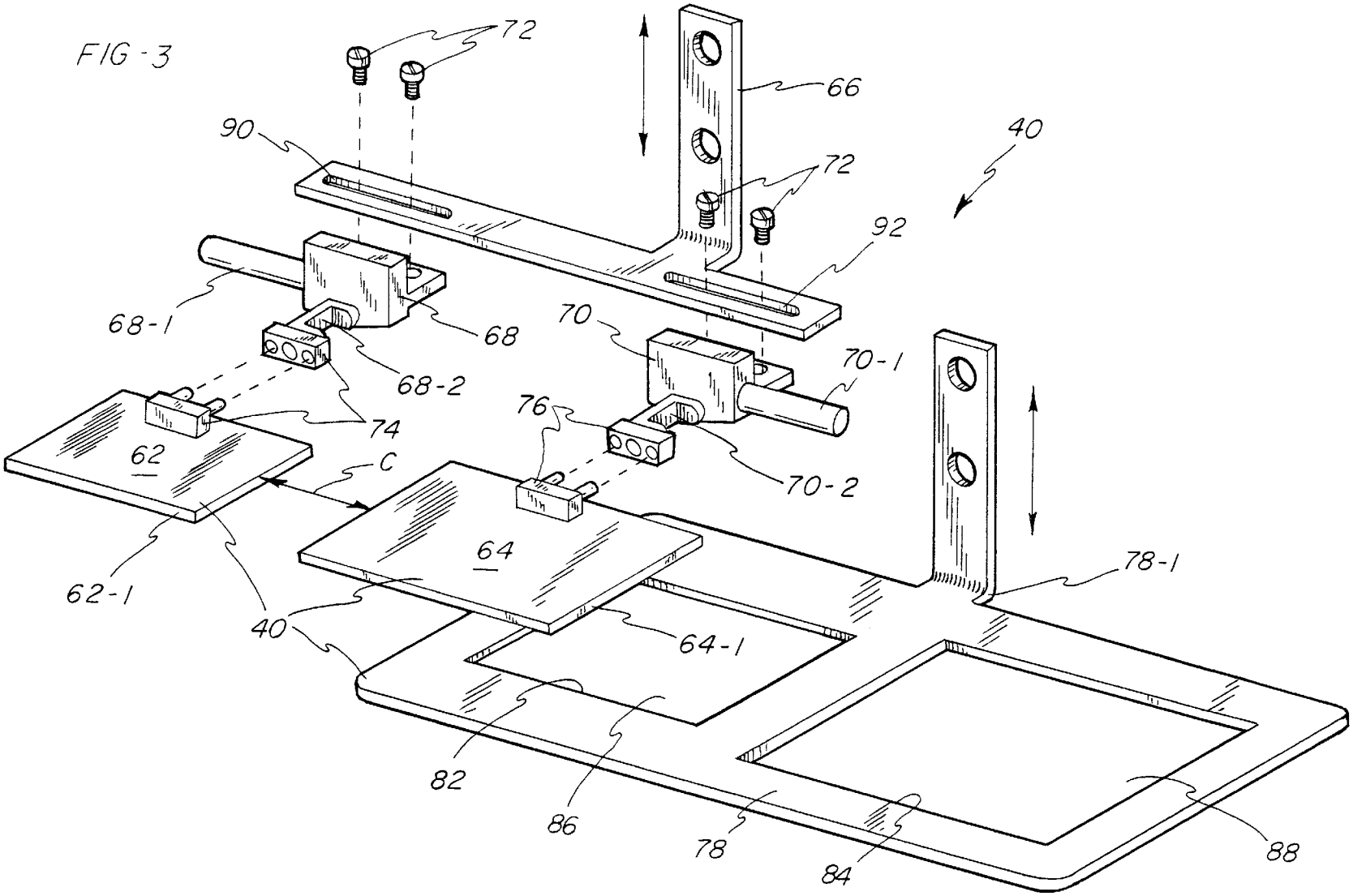
FIG. 3 is a perspective exploded view of the dual clamping system shown in FIG. 2.

As best shown in FIG. 3, the L-shaped bracket 66 comprises a pair of elongated slots 90 and 92 which permit the first and second quick release mechanisms 74 and 76 and clamps 62 and 64 to be moved or adjusted towards and away from each other. This permits the distance (indicated by double arrow C in FIG. 3) to be adjusted in order to accommodate a variety of different spacing arrangements between the first and second workpieces 12 and 14.

It is to be noted that the first clamp 62 has a peripheral or exterior edge 62-1 (FIG. 2) which defines a first predefined clamping area which generally corresponds to the inner portion 13 of the first workpiece 12. Likewise, the second clamp 64 has a peripheral or exterior edge 64-1 which defines a second predefined clamping area which generally corresponds to an inner portion 15 of the second workpiece 14. Although the first and second predefined clamping areas defined by the first and second clamps 62 and 64 are shown as being unequal or dissimilar, the first and second clamps 62 and 64 could have first and second predefined clamping means which are the same.

The dual clamp system 40 also comprises a peripheral clamp 78 which is coupled to the bracket 52 (FIG. 1) of drive means 42. The peripheral clamp 78 comprises an L-shaped bracket portion 78-1 for coupling the peripheral clamp 78 to the bracket 52 (FIG. 1) using the flat head screws 80. The peripheral clamp 78 is capable of simultaneously clamping at least a portion of a peripheral clamping area of the first and second workpieces 12 and 14. The peripheral clamping area of the first workpiece 12 is generally defined as the area between the first predetermined stitch 18 and peripheral edge 12-1. Likewise, the peripheral clamp area of the second workpiece 14 is generally defined as the area between peripheral edge 14-1 and the second predetermined stitch pattern 21. The peripheral clamp 78 comprises a first inner edge 82 and a second inner edge 84 which define a first aperture 86 and a second aperture 88 for receiving the first and second clamps 62 and 64, respectively. As best illustrated in FIG. 2, the inner edges 82 and 84 cooperate with the exterior edges 62-1 and 64-1, respectively, to define sewing areas 87 and 89 in which the sewing machine 10 may sew the first and second predetermined stitch patterns 18 and 21. Although the first and second clamps 62 and 64 and first and second apertures 86 and 88 have been shown as being generally rectangular in shape, they could be any desired shape. In the embodiment being described and shown, they have a shape which corresponds to the shape of the first and second workpieces 12 and 14.

It is to be noted that although the sewing machine is shown using the peripheral clamp 78, it should be appreciated that the clamping system 40 could be used without the peripheral clamp 78. Alternatively, the peripheral clamp 78 could be used alone, without the first and second inner clamps 62 and 64.

The peripheral clamp 78 is capable of simultaneously clamping a portion of the peripheral edge 12-1 (FIG. 2) of the first workpiece 12 and also a portion of the peripheral edge 14-1 of the second workpiece 14 against the sewing surface 34 of cloth plate 32.

It is to be noted that the master controller 20 is capable of selectively energizing the first solenoid 56 and second solenoid (not shown) in order to cause the inner clamps 62 and 64 and peripheral clamp 78 to move towards and away from the sewing surface 34.

The operation and method for sewing a plurality of workpieces at the sewing station 30 will now be described. An operator selects first and second clamps 62 and 64 having first and second predefined clamping areas, respectively, which generally correspond to the inner portions 13 and 15 of the first and second workpieces 12 and 14. The operator then mounts the first and second clamps 62 and 64 to the L-shaped bracket 66 using the quick release mechanisms 74 and 76, respectively. The operator may cause the master controller 20 to energize the solenoid 56 to move the bracket 50 in the direction of arrow D in FIG. 1 so that the first and second clamps 62 and 64 are in a non-clamping, raised position above the sewing surface 34.

In the embodiment being described, a suitable peripheral clamp 78 is selected and mounted to the bracket 52. The operator then causes the master controller 20 to energize the second solenoid (not shown) to cause the bracket 52 to move in the direction of arrow D so that the peripheral clamp 78 is also in a non-clamping position. The workpiece 16 (FIG. 2) is positioned at the sewing station 30 on the sewing surface 34 underneath the peripheral clamp and dual clamp. The first workpiece 12 is positioned on workpiece 16 in association with and underneath the first clamp 62, and the second workpiece 14 is positioned on workpiece 16 in association with and underneath the second clamp 64. The operator then causes the master controller 20 to energize the second solenoid (not shown) to move the bracket 52 of drive means 42 towards the sewing surface 34 so that the peripheral clamp 78 clamps a portion of the peripheral clamping area against the receiving workpiece 16. Master controller 20 then energizes the first solenoid 56 to move the bracket 50 towards the sewing surface 34 so that the first and second clamps 62 and 64 clamp the inner portions of the first and second workpieces 12 and 14, respectively, against the workpiece 16. The master controller 20 then energizes the drive means 42 to cause the dual clamp system 40 to move in the X and Y directions in accordance with the computer program (not shown) so that the first and second predetermined stitch patterns 18 and 21 can be sewn on the first and second workpieces 12 and 14, respectively.

Having sewn the first and second workpieces 12 and 14 on workpiece 16, the operator may then cause the master controller 20 to energize the first solenoid 56 and second solenoid (not shown) to cause the first and second clamps 62 and 64 and peripheral clamp 78 to unclamp the first and second workpieces 12 and 14. The workpiece 16 may then be removed from the sewing station 30 and a new workpiece 16 inserted in its place and the process repeated so that first and second workpieces 12 and 14 can be sewn onto another new workpiece 16.

It should be appreciated that, if desired, the operator could clamp and sew the first and second workpieces 12 and 14 on the workpiece 16 individually or one at a time.

Another method of sewing the first and second workpieces 12 and 14 will now be described. After the operator has inserted the receiving workpiece 16 in the sewing station 30, the first workpiece 12 may be placed on the receiving workpiece 16 under the first clamp 62. The operator may then cause master controller 20 to cause the peripheral clamp 78 and first clamp 62 to clamp the first workpiece 12 against the workpiece 16 so that the workpiece 12 may be sewn thereon. Master controller 20 then causes the sewing machine 10 to sew the first workpiece 12 onto the workpiece 16 with the first predetermined stitch pattern 18. The operator would then cause the master controller 20 to unclamp the first workpiece 12 and receiving workpiece 16. The operator could then adjust and position the receiving workpiece 16 so that the second workpiece 14 may be placed at a predetermined location on the receiving workpiece 16 where it is desired to have the second workpiece 14 located thereon. The master controller 20 then causes the peripheral clamp 78 and second clamp 64 to clamp the second workpiece 14 against the receiving workpiece 16. The master controller 20 would then cause the sewing machine 10 to sew the second workpiece 14 onto the receiving workpiece 16 with the second predetermined stitch pattern 21. After the second workpiece 14 is sewn on the receiving workpiece 16, the receiving workpiece 16 may be removed from the sewing station 30.

Advantageously, the embodiment being described permits a sewing machine 10 to simultaneously clamp and sew a plurality of workpieces at a sewing station 30. Also, this invention enables an operator to clamp workpieces having different shapes at the sewing station 30 without having to change any clamps in the sewing machine 10. The first and second workpieces 12 and 14 may be clamped and sewn in one sewing operation, or alternatively, they may be sewn separately onto the receiving workpiece 16 in the manner described above. This permits an operator to sew a plurality of workpieces onto the receiving workpiece 16 during one sewing operation, without the need for changing clamps.

Various changes or modifications in the invention described may occur to those skilled in the art without departing from the true spirit or scope of the invention. For example, although the first and second clamps 62 and 64 have been shown and described as being clamps which clamp the inner portions of the first and second workpieces 12 and 14, respectively, they could be a peripheral or template clamps (not shown) which have openings which define an area in which the sewing needle 38 can sew a stitch pattern. This may be particularly useful where the workpiece 16 to be sewn is small. In addition, although the embodiment being described herein is shown with the peripheral clamp 78, there may be sewing operations in which the peripheral clamp 78 is not used, such as when the periphery of the workpiece has to be sewn. Also, the peripheral clamp 78 could be configured to clamp the peripheral clamping area of only one of the first or second workpieces 12 and 14. Likewise, the sewing system of the present invention may be used with only the peripheral clamp 78 and without the first and second clamps 62 and 64. This may be particularly useful when sewing the inner area of the first and second workpieces 12 and 14.

The above description of the invention is intended to be illustrative only and not limiting and it is not intended that the invention be restricted thereto but that it be limited only by the true spirit and scope of the appended claims.

What is claimed is:

1. A clamp system for use on a programmable sewing machine comprising:

a first clamp for clamping a first workpiece;

a second clamp for clamping a second workpiece; and a coupler for coupling said first and second clamps to said programmable sewing machine such that the programmable sewing machine may sew an endless stitch pattern which encloses at least one of said first clamp or said second clamp.

2. The clamp system as recited in claim 1 wherein said coupler further comprises at least one 360° mechanism.

3. The clamp system as recited in claim 1 wherein said coupler comprises a first 360° mechanism coupled to said first clamp and a second 360° mechanism coupled to said second clamp.

4. The clamp system as recited in claim 2 wherein said at least one 360° mechanism comprises a U-shaped crank.

5. The clamp system as recited in claim 1 wherein said clamp system further comprises a peripheral clamp for clamping a periphery area of at least one of said first workpiece or said second workpiece.

6. The clamp system as recited in claim 1 wherein said first and second workpieces each comprise a peripheral clamp area; said clamp system further comprising a peripheral clamp for clamping the peripheral clamp areas of each of said first and second workpieces.

7. The clamp system as recited in claim 1 wherein said first and second workpieces comprise different shapes.

8. A clamp for use in a sewing machine for sewing a plurality of stitch patterns; said clamp comprising:

a clamp member defining a plurality of endless sewing apertures, each of said plurality of endless sewing apertures being capable of receiving at least one inner clamp, said at least one inner clamp cooperating with said clamp member to define at least one endless sewing area capable of receiving a sewing needle; and a coupling coupled to said clamp member to permit the sewing needle to sew entirely throughout said at least one endless sewing area.

9. The clamp as recited in claim 8 wherein said coupling further comprises a plurality of 360° mechanisms for enabling said sewing needle to sew throughout each of said plurality of sewing apertures.

10. The clamp as recited in claim 8 wherein said coupling comprises at least one 360° mechanism.

11. The clamp as recited in claim 8 wherein said clamp member further comprises:

a first inner clamp; and a second inner clamp.

12. The clamp as recited in claim 8 wherein said clamp member further comprises:

a peripheral clamp and at least one inner clamp.

13. The clamp as recited in claim 8 wherein said clamp member further comprises:

a peripheral clamp; and a plurality of inner clamps.

14. The clamp as recited in claim 8 wherein said sewing machine comprises a master controller, said coupling further comprising:

a first inner clamp;

a second inner clamp;

a first 360° mechanism coupled to said first inner clamp;

a second 360° mechanism coupled to said second clamp.

15. The clamp as recited in claim 14 further comprising:

at least one solenoid coupled to at least one of said first or second 360° mechanisms.

16. The clamp as recited in claim 14 further comprising:

a plurality of solenoids coupled to said first and second inner clamps.

17. A sewing machine for sewing a first predetermined stitch pattern on a first workpiece and a second predetermined stitch pattern on a second workpiece, said sewing machine comprising:

a master controller for controlling the operation of the sewing machine;

a first clamp for clamping an inner portion of the first workpiece against a sewing surface of the sewing machine;

a second clamp for clamping an inner portion of the second workpiece against the sewing surface of the sewing machine;

said first and second clamps being capable of clamping the inner portions of said first and second workpieces, respectively, so that said first predetermined stitch pattern and a second predetermined stitch pattern may be sewn around said inner portions;

at least one of said first or second predetermined stitch patterns being 360° degrees; and a driver coupled to said master controller for driving the first and second clamps towards and away from the sewing surface to cause said first clamp to clamp an inner portion of the first workpiece against the sewing surface and the second clamp to clamp an inner portion of the second workpiece against the sewing surface;

wherein said sewing machine further comprises:

a peripheral clamp which cooperates with at least one of said first clamp and said second clamp to claim either a peripheral edge of said first workpiece or a second peripheral edge of said second workpiece.

18. The sewing machine as recited in claim 17 wherein said peripheral clamp and said first and second clamps cooperate to define a first sewing aperture and a second sewing aperture, each of said first and second sewing apertures being capable of receiving a sewing needle on the sewing machine.

19. The sewing machine as recited in claim 18 wherein said first and second sewing apertures are both endless.

20. A method for sewing an endless stitch pattern on at least one of a plurality of workpieces, said method comprising the steps of:

clamping a first workpiece under a first clamp;

clamping a second workpiece under a second clamp;

sewing completely around an entire perimeter of either said first clamp or said second clamp to sew an endless stitch pattern on said first or second workpieces, respectively.

21. The method as recited in claim 20 wherein said method further comprises the step of:

situating said first and second workpieces on a third workpiece.

22. The method as recited in claim 20 wherein said method further comprises the step of:

clamping a peripheral edge of either said first or said second workpiece using a peripheral clamp.

23. The method as recited in claim 20 wherein said method further comprises the step of:

clamping a peripheral edge of both said first and second workpieces using a peripheral clamp.

24. The method as recited in claim 20 wherein said method further comprises the step of:

driving said first and second clamps against said first and second workpieces substantially simultaneously.

25. The method as recited in claim 20 wherein said method further comprises the step of:

driving said first and second clamps against said first and second workpieces substantially independently.

26. The method as recited in claim 20 wherein said method further comprises the step of:

sewing completely around said first and second clamps.

27. The method as recited in claim 26 wherein said first and second clamps are inner clamps, said method further comprises the step of:

clamping an inner portion of said first workpiece and an inner portion of said second workpiece with said first clamp and second clamp, respectively.

28. The method as recited in claim 20 wherein said method further comprises the step of:

positioning a first workpiece under said first clamp and a second workpiece under said second clamp;

forcing said first and second clamps against said first and second workpieces, respectively, substantially simultaneously.

29. The method as recited in claim 20 wherein said method further comprises the step of:

sewing an endless predetermined stitch pattern on said first and second workpieces.

30. The method as recited in claim 20 wherein said method further comprises the step of:

coupling said first and second clamps to the sewing machine using at least one 360° mechanism.

31. The method as recited in claim 20 wherein said method further comprises the step of:

coupling said first and second clamps to the sewing machine using a plurality of 360° mechanisms.

32. The method as recited in claim 20 wherein said first and second workpieces comprise different shapes.

33. The method as recited in claim 20 wherein said method further comprises the step of:

coupling said first and second clamps to said sewing machine so that said sewing machine can sew an endless stitch pattern around said first and second clamps.

34. The method as recited in claim 20 wherein said method further comprises the step of:

using at least one 360° mechanism to couple either said first clamp or said second clamp to said sewing machine.

35. The method as recited in claim 34 wherein said method further comprises the step of:

using a first 360° mechanism to couple said first clamp to said sewing machine and a second 360° mechanism to couple said second clamp to said sewing machine.

36. The method as recited in claim 20 wherein said at least one 360° mechanism is coupled to a solenoid, said method further comprising the step of:

energizing said solenoid to actuate said 360° mechanism.

37. The method as recited in claim 34 wherein said first 360° mechanism is coupled a first solenoid and said second 360° mechanism is coupled to a second solenoid, said method further comprises the step of:

energizing said first and second solenoids to actuate said first and second 360° mechanisms, respectively.

38. A sewing machine having a sewing surface, said sewing machine comprising:

a master controller for controlling the operation of a sewing machine;

a first clamp;

a second clamp;

a peripheral clamp defining a set of apertures of different shapes or sizes for receiving corresponding workpieces;

a drive assembly coupled to said master controller for driving said first clamp, said second clamp and said peripheral clamp towards and away from the sewing surface; and a coupler for coupling at least one of said first clamp, said second clamp or said peripheral clamp such that an endless stitch pattern may be sewn about the entire periphery of said clamp.

39. The sewing machine as recited in claim 38 wherein said coupler further comprises at least one 360° mechanism.

40. The sewing machine as recited in claim 38 wherein said coupler comprises a plurality of 360° mechanisms.

41. The sewing machine as recited in claim 38 wherein said at least one 360° mechanism comprises a generally U-shaped crank.

42. The sewing machine as recited in claim 38 wherein said first and second clamps are coupled to a first bracket and said peripheral clamp is coupled to a second bracket.

43. The sewing machine as recited in claim 42 wherein said sewing machine further comprises:

a first driver associated with said first bracket;

a second driver associated with said second bracket;

said master controller being coupled to said first and second drivers to independently or simultaneously energize said first and second drivers to drive said first bracket and said second bracket such that said first and second clamps or said peripheral clamp, respectively, are driven towards or away from said sewing surface of said sewing machine.

44. A clamp system for use on a sewing machine having a sewing surface for supporting a workpiece for quickly and successively attaching a set of labels of different sizes or shapes to the workpiece, said clamp system comprising:

a peripheral clamp defining a set of openings of different shapes or sizes for receiving the corresponding labels;

a set of corresponding inner clamps disposed within said openings and adapted to hold the labels against the workpiece on the surface, each of said inner clamps cooperating with the corresponding said opening to define therebetween a stitching aperture extending around each of said inner clamps;

a plurality of couplers extending across said stitching apertures for supporting said inner clamps so that an endless stitch pattern may be sewn on said labels.

45. The clamp system as recited in claim 44 wherein each of said plurality of couplers comprises:

a 360° mechanism.

46. The clamp as recited in claim 45 wherein said 360° mechanism comprises:

a generally U-shaped crank.

47. The clamp system as recited in claim 44 wherein said clamp system further comprises:

a drive for supporting said plurality of couplers and said inner clamps for generally vertical movement as a unit relatively to said peripheral clamp.

48. The clamp system as recited in claim 44 wherein said sewing machine comprises a master controller coupled to said plurality of couplers, each of said plurality of couplers comprising at least one solenoid coupled to said master controller being capable of energizing said coupler to cause said 360° mechanisms to rotate substantially simultaneously.

49. The clamp system as recited in claim 44 wherein each of said plurality of couplers comprises at least one adjuster for adjustably positioning said first and second clamps on a bracket coupled to the sewing machine.

* * * * *

UNITED STATES PATENT AND TRADEMARK OFFICE

CERTIFICATE OF CORRECTION

PATENT NO : 5,865,137

DATED : February 2, 1999

INVENTOR(S) : Frye

It is certified that error appears in the above-identified patent and that said Letters Patent are hereby corrected as shown below:

Claim 17, column 8, line 8, please delete "an" and insert --said-- therefor.

Claim 17, column 8, line 10, please delete "an" and insert --said-- therfor.

Claim 17, column 8, line 14, please delete "clamp to claim" and insert --clamp to clamp-- therefor.

Claim 37, column 9, line 40, after "coupled" please insert --to--.

Signed and Sealed this

Tenth Day of April, 2001

*Attest:*

Nicholas P. Godici

NICHOLAS P. GODICI

*Attesting Officer*

*Acting Director of the United States Patent and Trademark Office*